US011749957B2

(12) United States Patent
Yang et al.

(10) Patent No.: US 11,749,957 B2
(45) Date of Patent: Sep. 5, 2023

(54) CABLE STRAIGHTENING DEVICE

(71) Applicants: Tyco Electronics (Shanghai) Co. Ltd., Shanghai (CN); TE Connectivity Services GmbH, Schaffhausen (CH)

(72) Inventors: An Yang, Shanghai (CN); Lvhai Hu, Shanghai (CN); Dandan Zhang, Shanghai (CN); Roberto Francisco-Yi Lu, Bellevue, WA (US); Jian Cao, Shanghai (CN); Yun Liu, Shanghai (CN)

(73) Assignees: Tyco Electronics (Shanghai) Co., Ltd., Shanghai (CN); TE Connectivity Solutions GmbH, Schaffhausen (CH)

( * ) Notice: Subject to any disclaimer, the term of this patent is extended or adjusted under 35 U.S.C. 154(b) by 163 days.

(21) Appl. No.: 17/087,159

(22) Filed: Nov. 2, 2020

(65) Prior Publication Data

US 2021/0135418 A1 May 6, 2021

(30) Foreign Application Priority Data

Nov. 1, 2019 (CN) ..... 201911062141.5

(51) Int. Cl.
*B21F 1/02* (2006.01)
*H01R 43/28* (2006.01)

(52) U.S. Cl.
CPC ..... *H01R 43/28* (2013.01); *B21F 1/02* (2013.01)

(58) Field of Classification Search
CPC .... B21F 1/02; B21D 3/02; B21D 3/05; B21D 3/16; B21D 3/08; H01R 43/28
See application file for complete search history.

(56) References Cited

U.S. PATENT DOCUMENTS 2,293,156 A * 8/1942 Mason ..... B21D 3/05 72/162
2,517,309 A * 8/1950 Heller ..... B21F 1/02 72/162

(Continued)

FOREIGN PATENT DOCUMENTS

CN 101716636 A 6/2010
CN 102029336 A 4/2011

(Continued)

OTHER PUBLICATIONS

CN 208613613U, Wu et al. Mar. 2019.*

(Continued)

*Primary Examiner* — Edward T Tolan
(74) *Attorney, Agent, or Firm* — Barley Snyder

(57) ABSTRACT

A cable straightening device includes a plurality of cable straightening units connected in series. Each of the cable straightening units includes a base, a pair of rows of rollers mounted on the base and cooperating with each other to define a pressing path extending in a row direction, and a mounting frame disposed on at least one end of a pair of opposite ends of the base in the row direction. A cable is pressed by the rows of rollers while passing through the pressing path. Any two adjacent cable straightening units are assembled together at the mounting frame of each so that center lines of the pressing paths of two adjacent cable straightening units are aligned with each other.

15 Claims, 14 Drawing Sheets

(56) References Cited

U.S. PATENT DOCUMENTS

| | | | | | |
|---|---|---|---|---|---|
| 3,916,662 | A * | 11/1975 | Arnold | B21D 43/285 33/657 |
| 4,005,592 | A * | 2/1977 | Haeussler | B21F 1/02 72/165 |
| 4,464,919 | A * | 8/1984 | Labbe | B21F 1/02 140/147 |
| 5,768,930 | A | 6/1998 | Eckehard | |
| 8,763,436 | B2 * | 7/2014 | Knewtson | B21C 19/00 140/147 |
| 8,978,435 | B2 | 3/2015 | Viviroli | |
| 9,873,162 | B2 * | 1/2018 | Negishi | B23K 9/12 |
| 2014/0216594 | A1 * | 8/2014 | Mizutani | B21F 1/02 140/147 |
| 2021/0346929 | A1 * | 11/2021 | Keil | B21C 51/00 |

FOREIGN PATENT DOCUMENTS

| | | | |
|---|---|---|---|
| CN | 102366803 | A | 3/2012 |
| CN | 202206735 | U | 4/2012 |
| CN | 102641973 | A | 8/2012 |
| CN | 102756052 | A | 10/2012 |
| CN | 203245316 | U | 10/2013 |
| CN | 104190823 | U | 12/2014 |
| CN | 104308037 | A | 1/2015 |
| CN | 204308395 | U | 5/2015 |
| CN | 107159826 | A | 9/2017 |
| CN | 206779344 | U | 12/2017 |
| CN | 208613613 | U | 3/2019 |
| CN | 208879588 | U | 5/2019 |
| CN | 209334614 | U | 9/2019 |
| DE | 19606875 | C1 | 9/1997 |
| GB | 115332 | A | 5/1918 |
| GB | 873332 | A | 7/1961 |

OTHER PUBLICATIONS

KR20100111909A, Kim Oct. 2010.*

Chinese Office Action with English translation, Application No. 201911062141.5, dated Jul. 26, 2022, 26 pages.

Third Office Action from the National Intellectual Property Administration Office of China dated Mar. 21, 2023 with the English translation thereof, corresponding to Application No. 201911062141.5, 22 pages.

* cited by examiner

CABLE STRAIGHTENING DEVICE

CROSS-REFERENCE TO RELATED APPLICATION

This application claims the benefit of the filing date under 35 U.S.C. § 119(a)-(d) of Chinese Patent Application No. 201911062141.5, filed on Nov. 1, 2019.

FIELD OF THE INVENTION

At least one embodiment of the disclosure relates to a cable straightening device and, more particularly, to a cable straightening device adapted to straighten a cable with a bent portion.

BACKGROUND

In order to facilitate storage, transportation and management, a cable such as an electrical cable, a wire, a rope, and an optical cable is usually wound into rolls which are unwound during use. Due to the winding, the unwound cable may not be straight and may have some minor bent portions. In this case, it is necessary to straighten the bent cable and eliminate these bent portions.

Generally, a stretching system suitable for stretching a cable mainly comprises a cable straightening device and a conveying/stretching device. The cable to be stretched passes through the cable straightening device, and the conveying/stretching device conveys the cable to the cable straightening device or pulls the cable out of the cable straightening device. The cable is pressed and straightened while passing through the cable straightening device. The known stretching system, however, can only press the cable along a single radial direction.

SUMMARY

A cable straightening device includes a plurality of cable straightening units connected in series. Each of the cable straightening units includes a base, a pair of rows of rollers mounted on the base and cooperating with each other to define a pressing path extending in a row direction, and a mounting frame disposed on at least one end of a pair of opposite ends of the base in the row direction. A cable is pressed by the rows of rollers while passing through the pressing path. Any two adjacent cable straightening units are assembled together at the mounting frame of each so that center lines of the pressing paths of two adjacent cable straightening units are aligned with each other.

BRIEF DESCRIPTION OF THE DRAWINGS

The invention will now be described by way of example with reference to the accompanying Figures, of which.

DETAILED DESCRIPTION OF THE EMBODIMENTS

Figure 1:
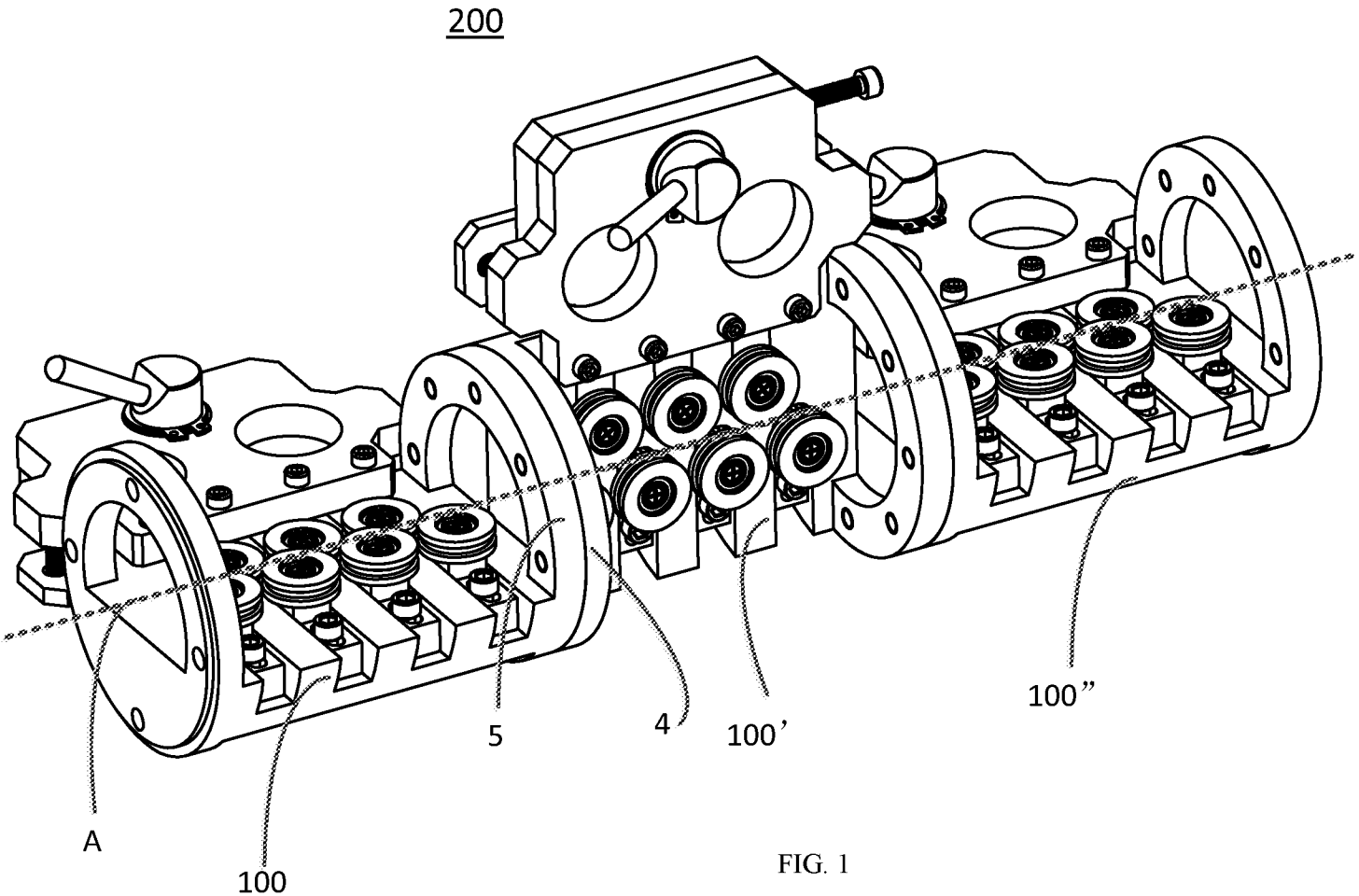
FIG. 1 is a perspective view of a cable straightening device according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
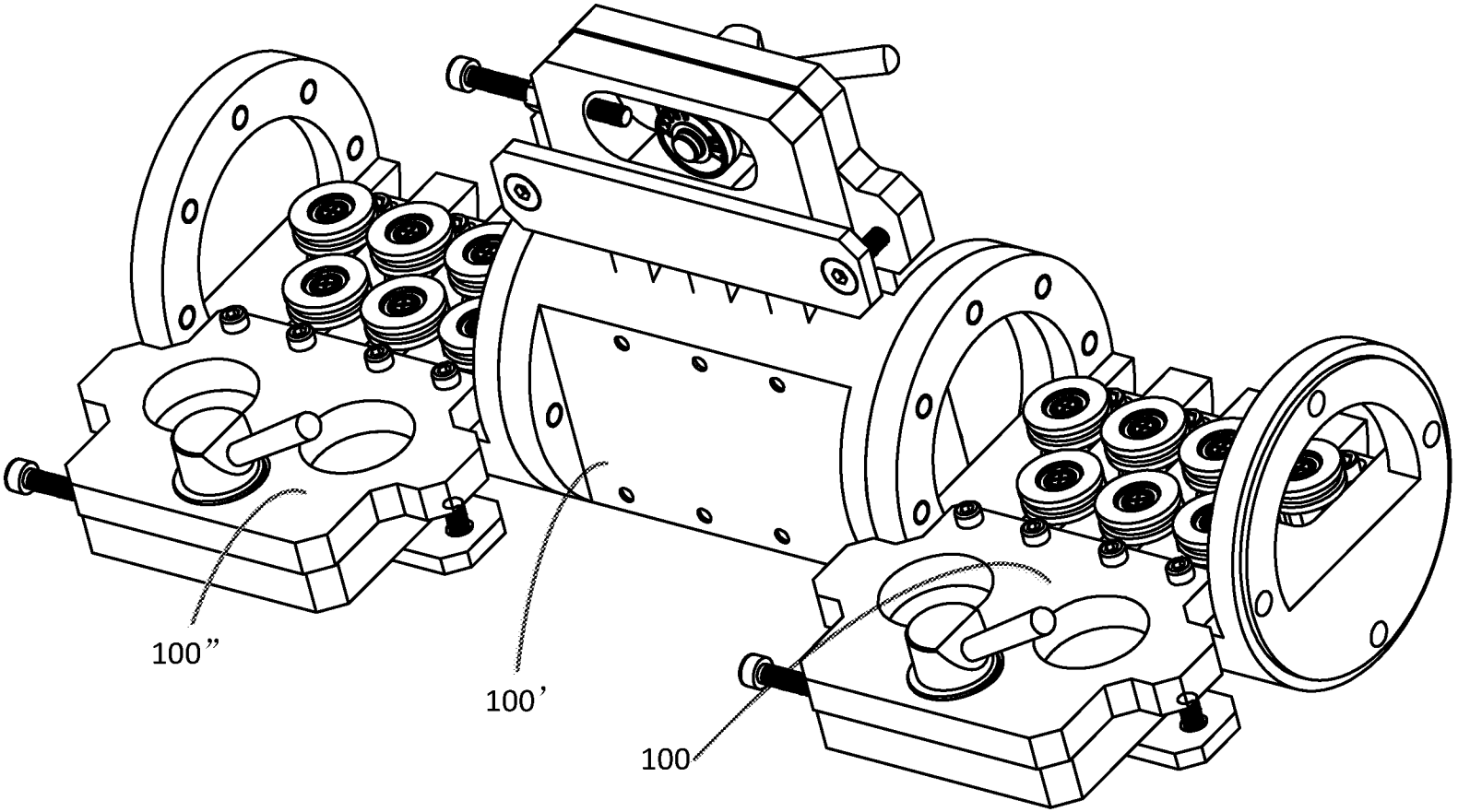
FIG. 2 is another perspective view of the cable straightening device.
Figure 3:
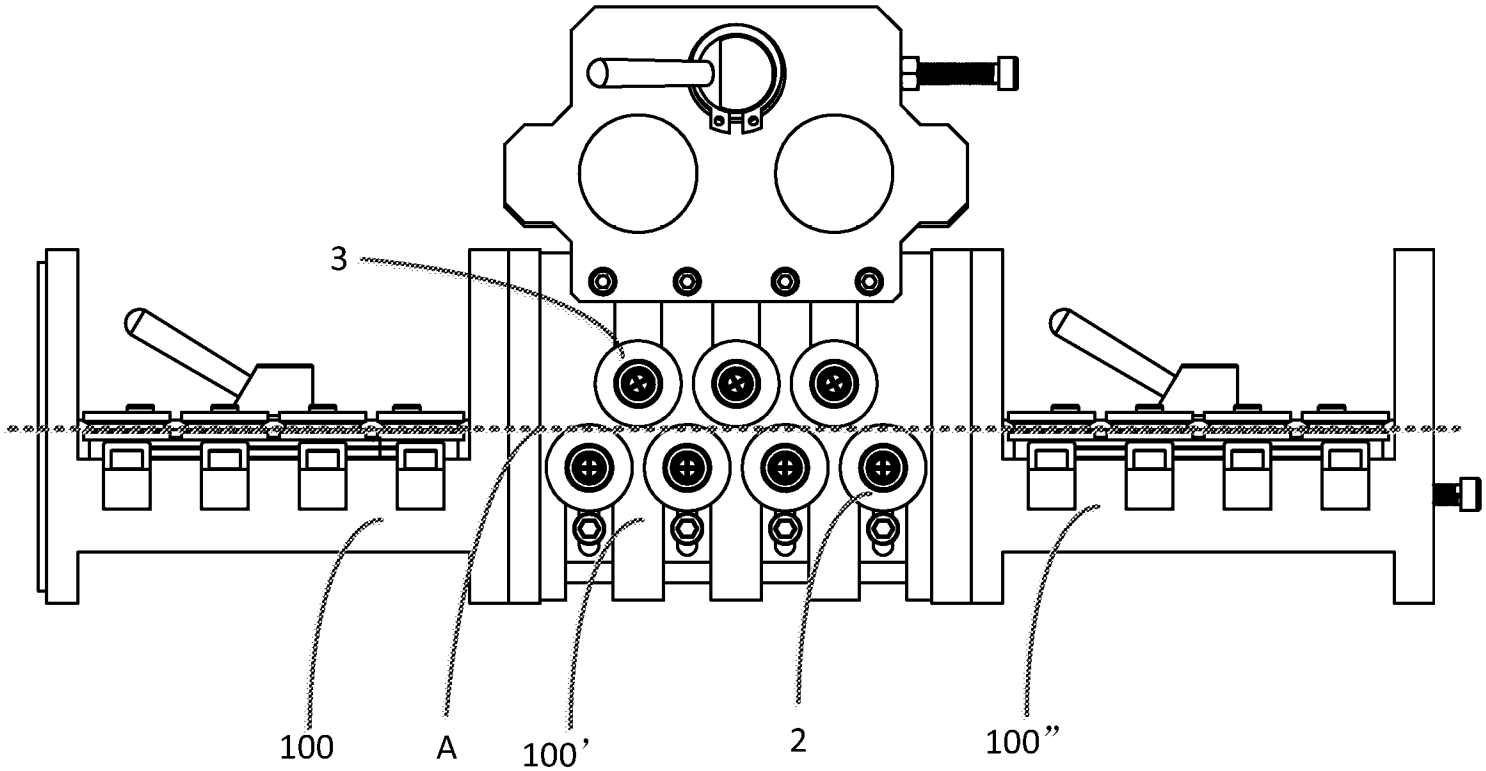
FIG. 3 is a front view of the cable straightening device.

A cable straightening device 200, as shown in FIGS. 1 to 3, is adapted to straighten a cable such as an electrical cable, a wire, a rope, an optical cable and the like, and comprises a plurality of cable straightening units 100. As shown in FIGS. 1 to 7, in an embodiment, each of the cable straightening units 100 includes a base 1, two rows of rollers 2, 3, and one or two mounting frames 4 and 5.

In an exemplary embodiment of the disclosure, as shown in FIGS. 1 to 7, the two rows of rollers 2, 3 of each of the cable straightening units 100 are mounted on the base 1 and cooperated with each other to define a pressing path extending in a row direction (an extending direction of the cable) and having a center line A. The cable is pressed by the two rows of rollers 2, 3 when passing through the pressing path. The two mounting frames 4 and 5 are provided at opposite ends of the base 1 in the row direction. In an alternative embodiment of the disclosure, only one mounting frame 4 or 5 may be provided.

The base 1 may be mounted on a support frame by the mounting frame 4 or 5 to support the cable straightening unit 100. Any two adjacent cable straightening units 100 and 100', or 100' and 100", as shown in FIGS. 1 to 3, are assembled together by the two adjacent mounting frames 4 and 5, so that the center lines A of the pressing paths of the two adjacent cable straightening units 100, 100', 100" are aligned with each other, or located on the same straight line. In this way, a length of the pressing path may be increased, thereby improving a straightening effect of the cable.

During straightening the cable, there is further provided a conveying device which is adapted to convey the cable to the cable straightening unit 100, and/or a pulling device which is adapted to pull the cable from the cable straightening device, so that the cable is driven to pass through the pressing path of the cable straightening device and straightened under the press of the two rows of rollers 2, 3, thereby eliminating a bent portion of the cable.

In an exemplary embodiment of the disclosure shown in FIGS. 1 to 7, the mounting frames 4 and 5 of the two adjacent cable straightening units 100 and 100' or the two adjacent cable straightening units 100' and 100" are arranged such that the respective two rows of rollers 2 and 3 of the two adjacent cable straightening units press the cable in different radial directions of the cable. In this way, it is possible to straighten the bent portions of the cable in different directions.

In an exemplary embodiment of the disclosure, as shown in FIGS. 1 to 7, in each of the cable straightening units 100, 100', 100", such as the cable straightening unit 100, each of the mounting frames 4, 5 has a plurality of mounting portions 41, 51 through which the base 1 is mounted on the mounting frame of another cable straightening unit or a separate support frame. The mounting portion 41, 51 is arranged so that the base 1 is mounted in different postures to allow the two rows of rollers 2, 3 to press the cable in the different radial directions of the cable.

It should be understood that, in the embodiment of the disclosure, the posture of the base 1 may refer to an angle formed by a flat surface of the base 1 relative to a horizontal plane, or an angle formed by the radial direction of the two rows of rollers 2, 3 relative to the horizontal plane. A radial direction of the rollers 2, 3 of the two cable straightening units 100 and 100' may be varied by changing an alignment of the mounting portions 41, 51 on the mounting frames 4, 5 of the two cable straightening units 100 and 100'. In an exemplary embodiment of the disclosure, the mounting portion 41, 51 comprises a plurality of through holes through which bolts are inserted to connect the two cable straightening units 100, 100' with each other.

As shown in FIGS. 4 to 7, in an exemplary embodiment of the disclosure, each of the mounting frames 4, 5 is formed as an annular frame, a center of an inscribed circle of which is located on the center line A of the pressing path. Further, each of the mounting portions 41, 51 is located on a circumference of the inscribed circle and arranged at regular intervals on the circumference. That is, any two adjacent mounting portions have the same central angle. In the illustrated embodiment, the annular frame is a circular ring-shaped frame. In an alternative embodiment, the annular frame may be a regular polygonal frame, such as a regular triangle frame, a regular quadrilateral frame, a regular hexagon frame, or a regular octagonal frame.

In an exemplary embodiment of the disclosure shown in FIGS. 4 to 7, the cable straightening unit 100 comprises two mounting frames 4, 5. One mounting frame 4 of the two mounting frames 4, 5 has four regularly spaced mounting portions 41, and the other mounting frame 5 is provided with eight regularly spaced mounting portions 51. In an alternative embodiment, the cable straightening unit 100 may comprise two mounting frames 4, 5, one of the two mounting frames 4, 5 is provided with three regularly spaced mounting portions 41, 51, and the other mounting frame is provided with six regularly spaced mounting portions 41, 51.

In an exemplary embodiment of the disclosure, as shown in FIGS. 4 to 9, the base 1 includes a first base 11, at both ends of which the two mounting frames 4, 5 are integrally provided, and a plurality of support frames 12 through which a first row of rollers 2 in the two rows of rollers 2, 3 are mounted on the first base 11. The first base 11 has a substantially flat upper surface and a lower surface 113, and two arc-shaped side surfaces.

Figure 8:
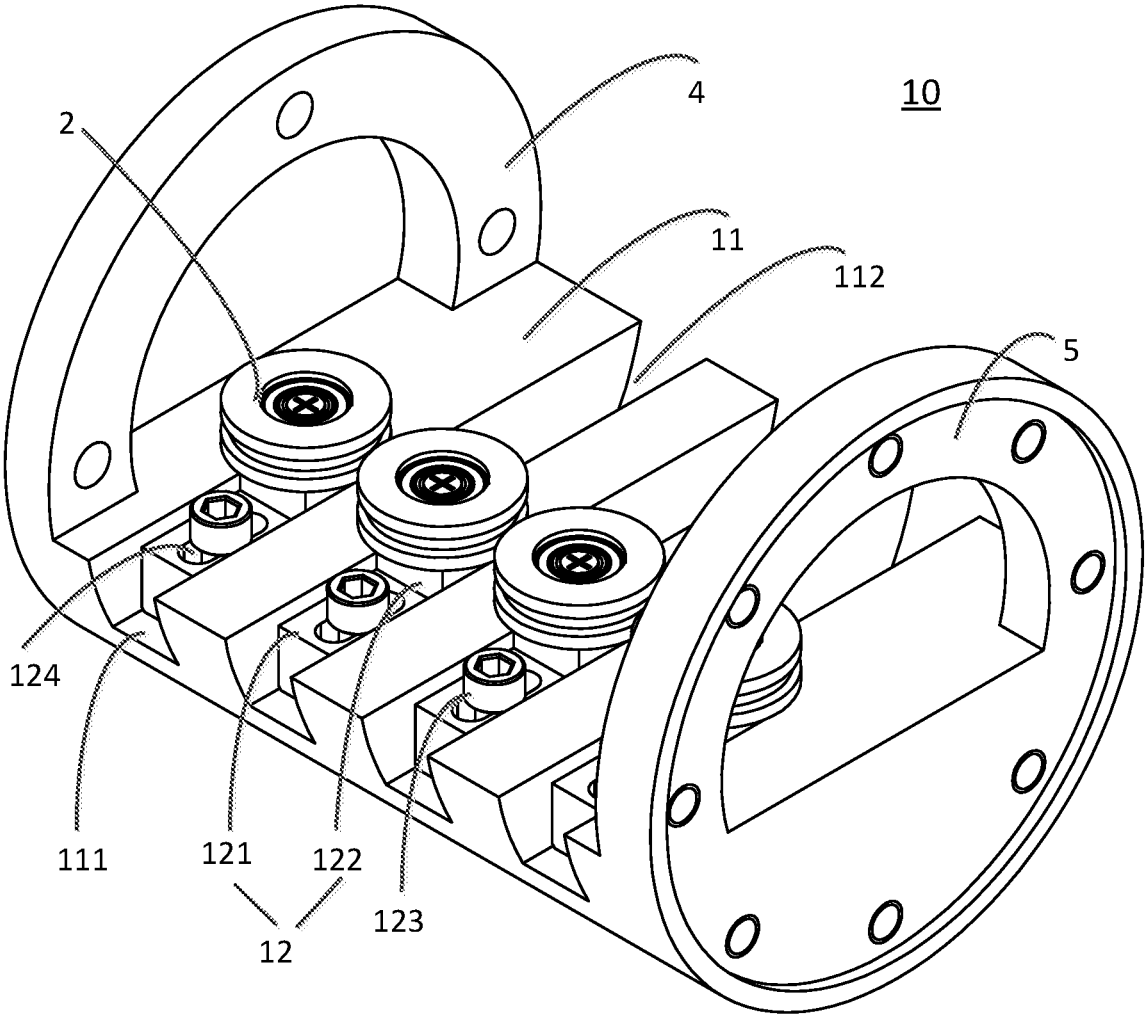
FIG. 8 is a top perspective view of a first part of a cable straightening unit according to an embodiment.
Figure 9:
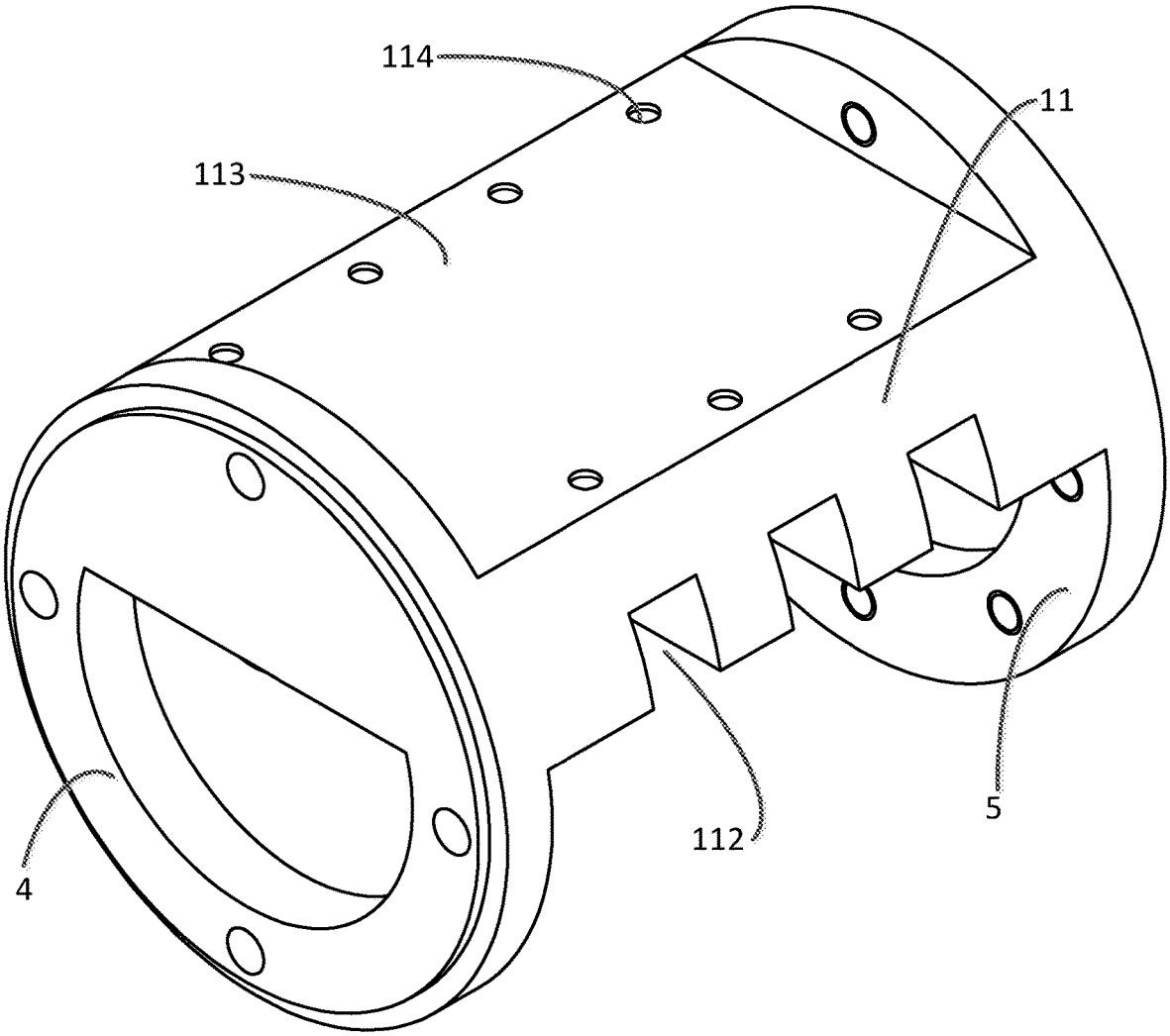
FIG. 9 is a bottom perspective view of the first part of FIG. 8.

In an exemplary embodiment of the disclosure shown in FIG. 8, each of the support frames 12 has a substantially L-shaped profile, and has a horizontal arm 121 mounted on the first base 11 by a first connection member 123 and an vertical arm 122 perpendicular to the horizontal arm 121 and configured to rotatably support a first roller in the first row of rollers 2. A row of threaded holes 114 is provided in the first base 11, as shown in FIG. 9, and the horizontal arm 121 is threadedly connected to the first base 11 by a first connection member 123 such as a bolt.

In an exemplary embodiment of the disclosure, as shown in FIG. 8, the first base 11 is provided with a plurality of first mounting grooves 111 extending perpendicular to the row direction. The horizontal arm 121 is provided with an adjustment hole 124 formed as an elongated groove extending in a transverse direction perpendicular to the row direction. The first connection member 123 passes through the adjustment hole 124 to mount the horizontal arm 121 in the first mounting groove 111 so that a distance between an outer edge of the first roller 2 and the center line A of the pressing path is adjustable. A position of the first connection member 123 in the adjustment hole 124 may be changed according to a diameter of the cable to be straightened so as to adjust the distance between the outer edge of the first roller 2 and to the center line A of the press path. In this way, it is possible to straighten the cables with different diameters.

In an exemplary embodiment of the disclosure, as shown in FIGS. 4 to 7 and 10 to 13, the base 1 includes a second base 13 mounted on the first base 11 by a plurality of second connection members 18 such as bolts, and a movable frame 14 through which a second row of rollers 3 in the two rows of rollers are respectively mounted on the second base 13.

Figure 11:
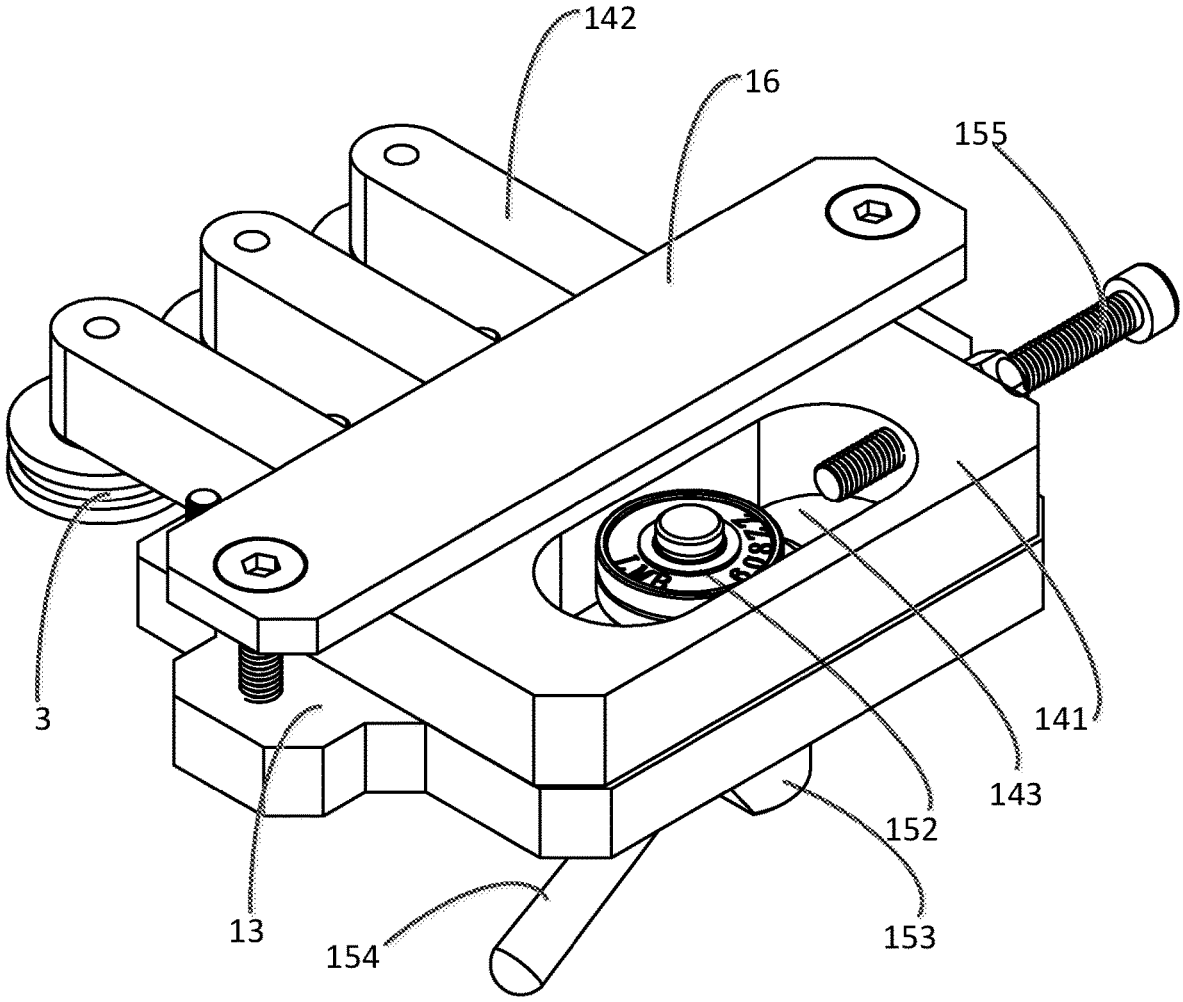
FIG. 11 is another perspective view of the second part of FIG. 10.
Figure 12:
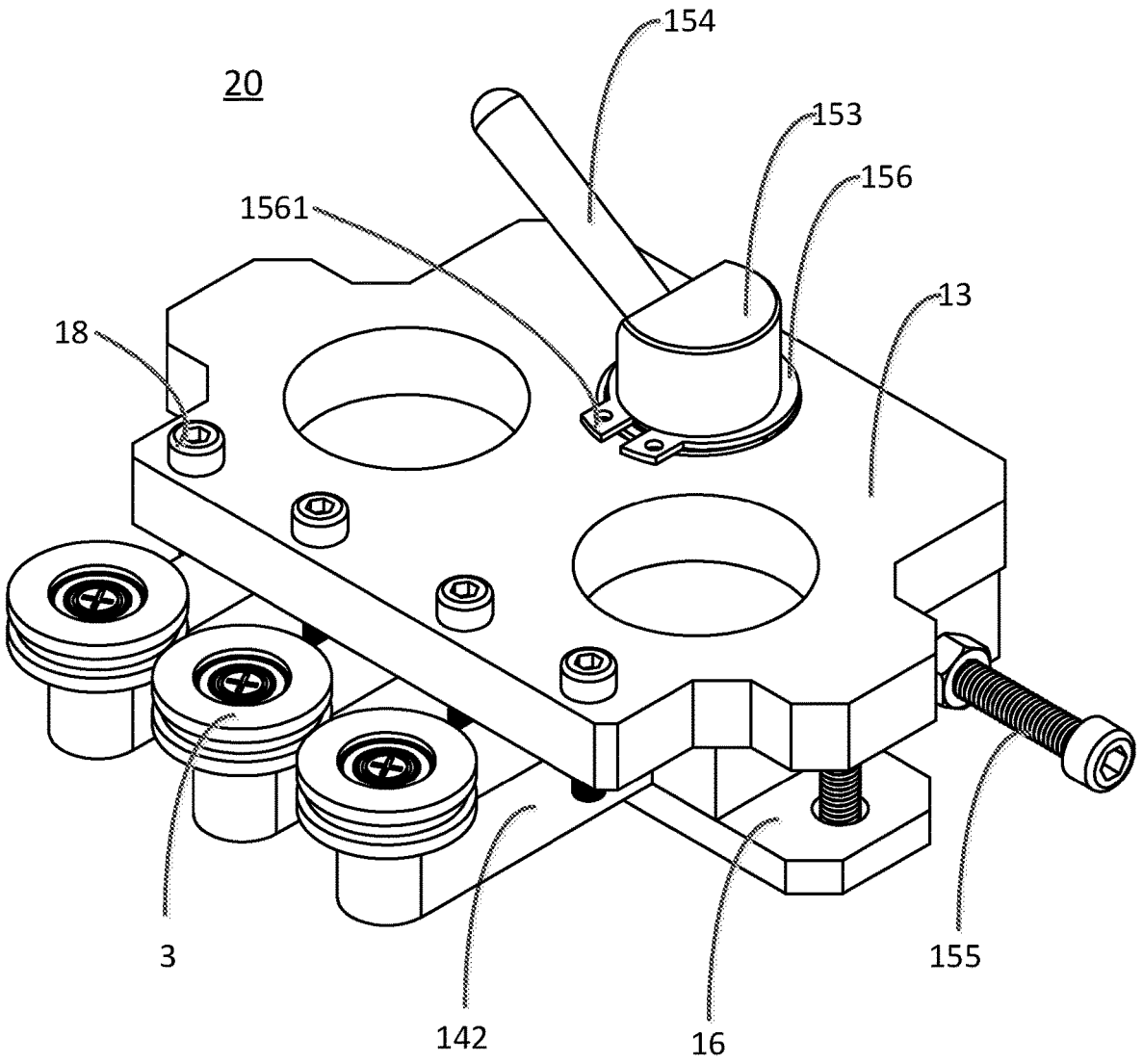
FIG. 12 is another perspective view of the second part of FIG. 10.

In an exemplary embodiment of the disclosure, the movable frame 14 comprises a main body portion 141 movably mounted on the second base 13, and a plurality of support arms 142 parallel extending from the main body portion 141, as shown in FIG. 11. A plurality of second rollers in the second row of rollers 3 are respectively rotatably mounted at ends of the support arm 142. In this way, the multiple support arms 142 may be driven to move with the movement of the main body 141.

In an exemplary embodiment of the disclosure shown in FIGS. 10 to 13, the base 1 further comprises an adjustment device 15 mounted in the second base 13 and configured to push the movable frame 14 to move in the transverse direction (the radial direction of the cable) perpendicular to the row direction to adjust a distance between an outer edge of the second roller in the second row of rollers 3 and the center line A of the press path.

In an exemplary embodiment of the disclosure, as shown in FIGS. 10 to 14, the adjustment device 15 includes a drive shaft 151 rotatably mounted in the second base 13, and a drive wheel 152 mounted at one end of the drive shaft 151 and having an axis offset from that of the drive shaft 151. The drive shaft 151 is rotated to drive the movable frame 14 to move in the transverse direction by the drive wheel 152. In other words, the drive wheel 152 is formed as an eccentric wheel with respect to the drive shaft 151. In this way, the drive shaft 151 is rotated to push the movable frame 14 to move in the transverse direction, thereby adjusting the distance of the outer edge of the second roller in the second row of rollers 3 and the center line A of the press path. Therefore, the cables having different diameters may be straightened by the cable straightening unit 100.

In an exemplary embodiment of the disclosure, the main body portion 141 has a drive groove 143 into which the drive wheel 152 extends, as shown in FIG. 11. Further, the adjustment device 15 includes an operating portion 153 protruding from the second base 13 at an end of the drive shaft 151 opposite to the drive wheel 152, i.e., from a low portion of the second base 13 as shown in FIG. 11. The drive shaft 151 is driven to rotate by operating the operating portion 153. A radially extending operating rod 154 is mounted on the operating portion 153 to increase a torque when rotating the operating portion 153.

In an exemplary embodiment of the disclosure shown in FIGS. 10 to 13, the adjustment device 15 further comprises a positioning portion 155 adapted to prevent the drive shaft 151 or the drive wheel 152 from being rotated, thereby maintaining a pressing force of the second row of rollers 3 for pressing the cable. In an exemplary embodiment of the disclosure, the positioning portion 155 comprises a screw rod protruding into the drive groove 143 from outside the second base 13. The screw rod may be operated to abut against the drive wheel 152 to prevent the drive wheel 152 from being rotated.

Figure 10:
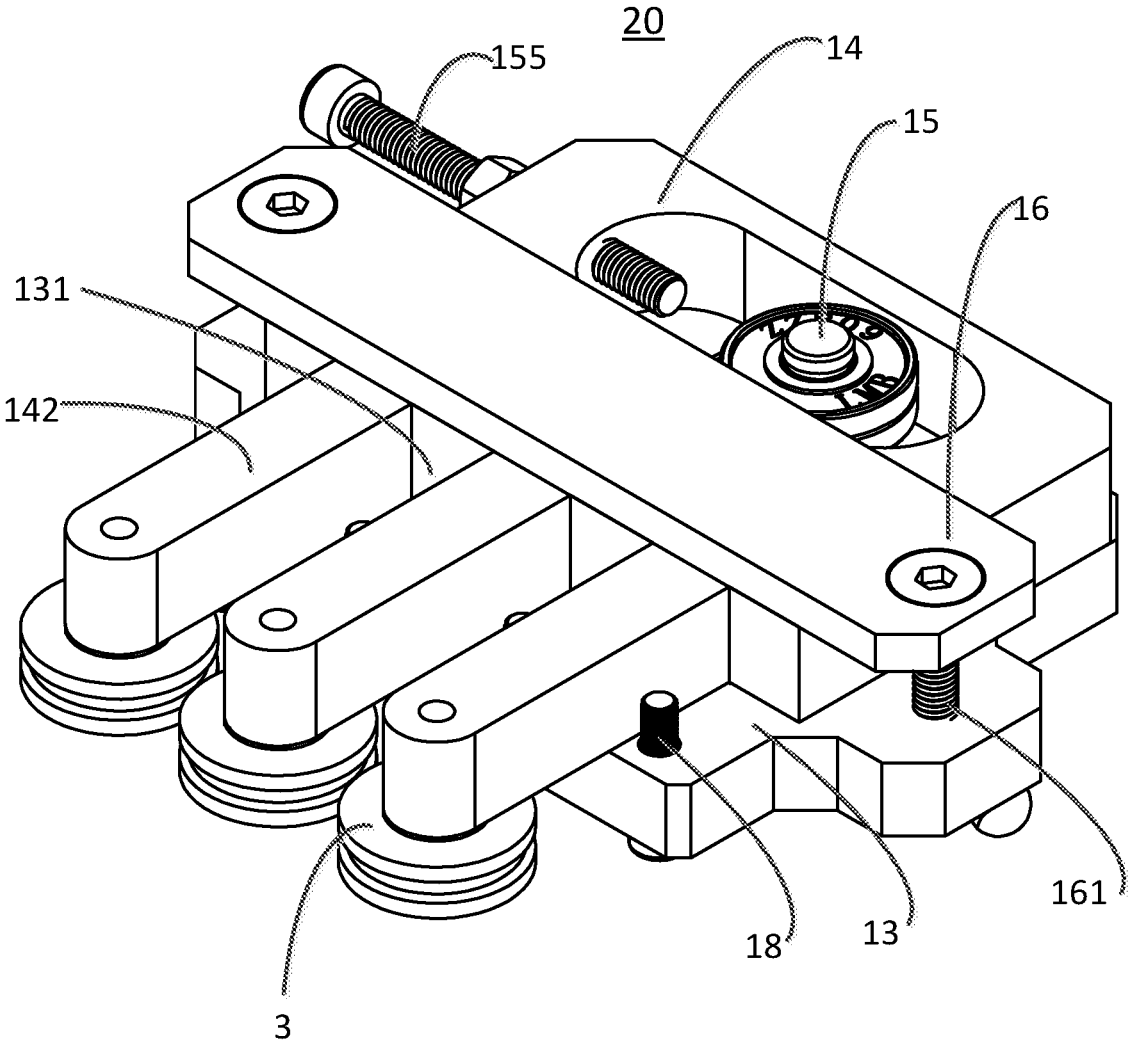
FIG. 10 is a perspective view of a second part of the cable straightening unit.

In an exemplary embodiment of the disclosure, the second base 13 is provided with a plurality of partition portions 131, as shown in FIG. 10, and each of the support arms 142 passes through a gap between two adjacent partition portions 131 to guide the support arm 142 moves smoothly. The base 1 further comprises a holding portion 16 arranged on the partition portions 131 and connected to the second base 13 to hold the movable frame 14 on the second base 13. For example, the holding portion 16 is attached to the second base 13 by the bolt 161 so that the support arm 142 may be reliably held on the second base 13.

Figure 13:
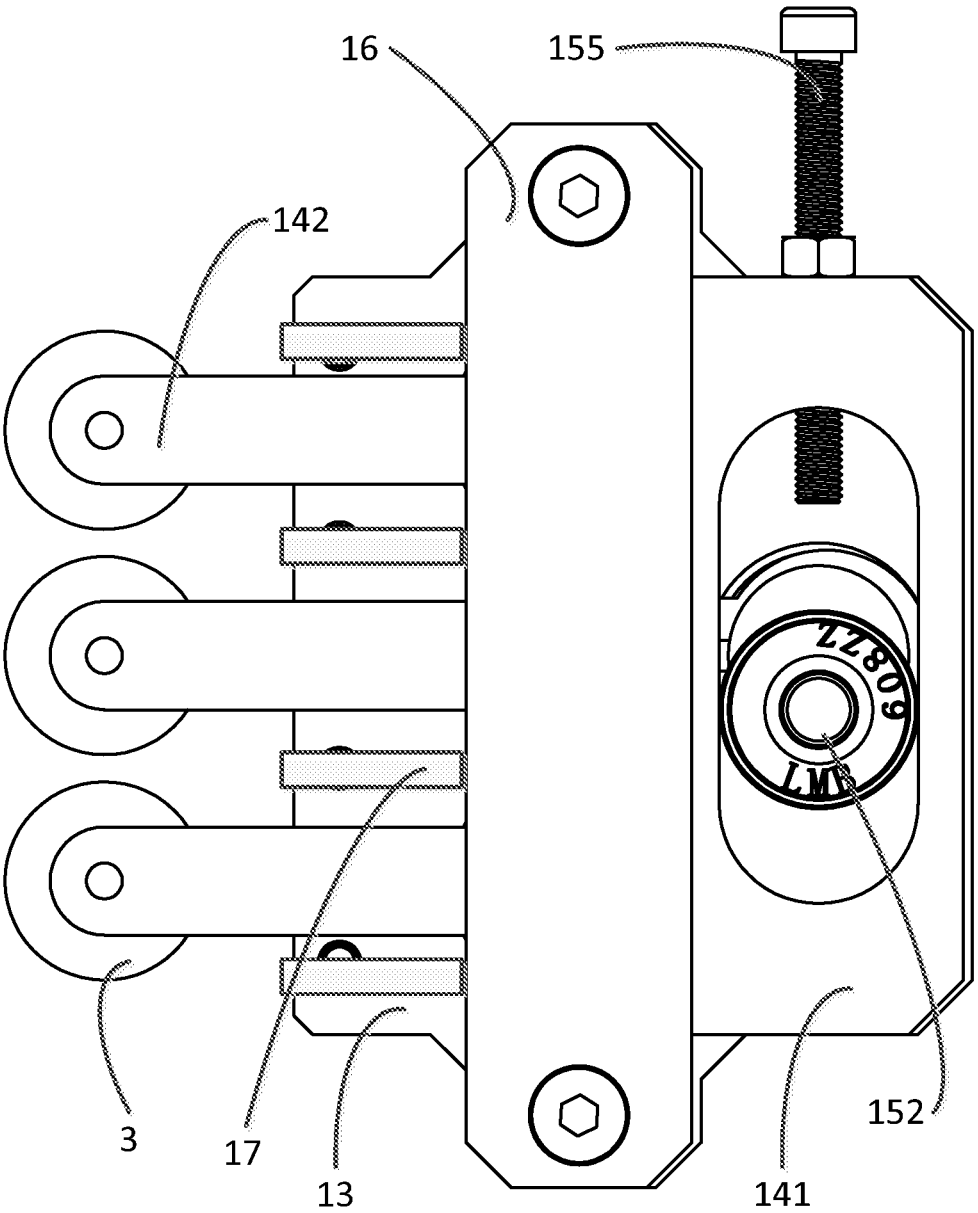
FIG. 13 is a top view of the second part of FIG. 10.
Figure 14:
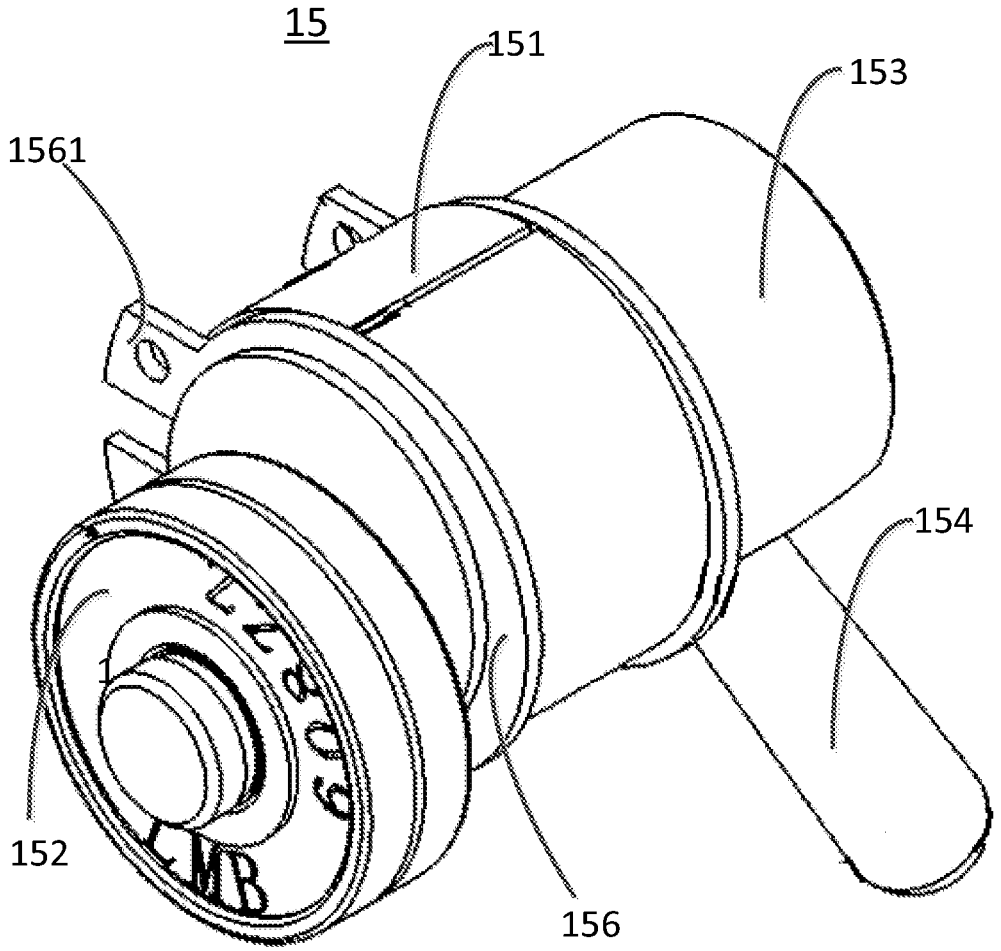
FIG. 14 is a perspective view of an adjustment device of the cable straightening device according to an embodiment.

In an exemplary embodiment of the disclosure, shown in FIG. 13, the base 1 further comprises a plurality of elastic members 17 mounted on the second base 13 at one end thereof and abutted against the side of the first base 11 at the other end thereof so that the movable frame 14 is moved toward the pressing path against an elastic force of the elastic member 17. In this way, it is possible to ensure that the movable frame 14 swings freely.

Figure 4:
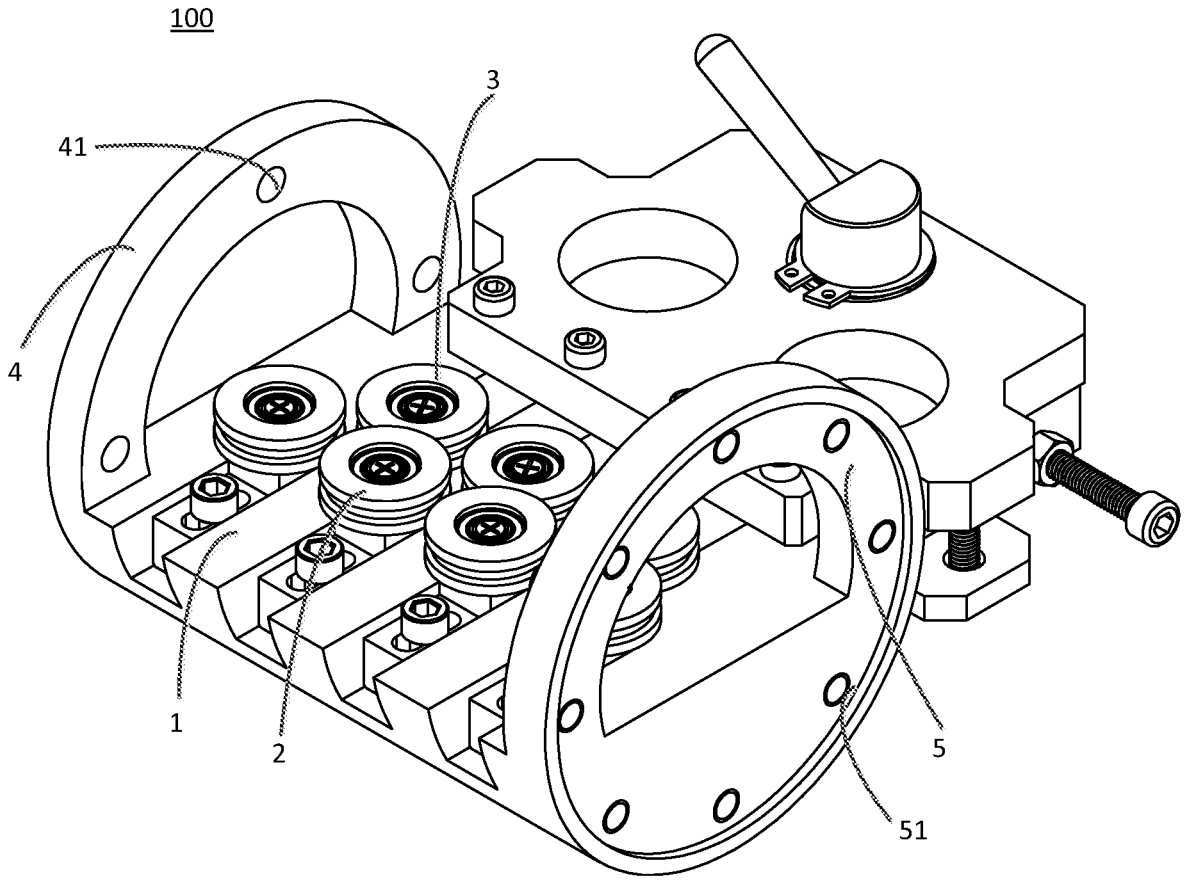
FIG. 4 is a top perspective view of a cable straightening unit according to an embodiment.
Figure 5:
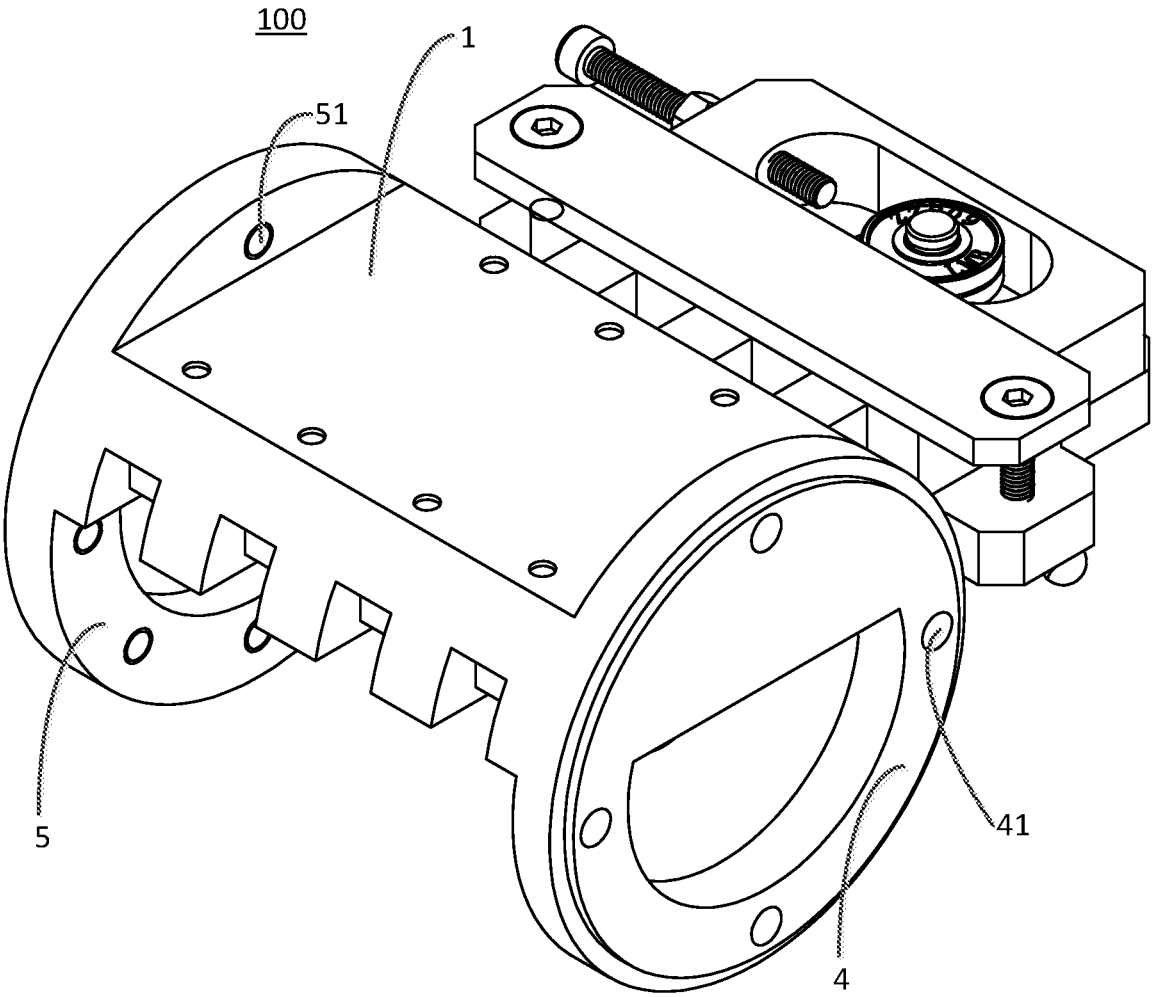
FIG. 5 is a bottom perspective view of the cable straightening unit of FIG. 4.
Figure 6:
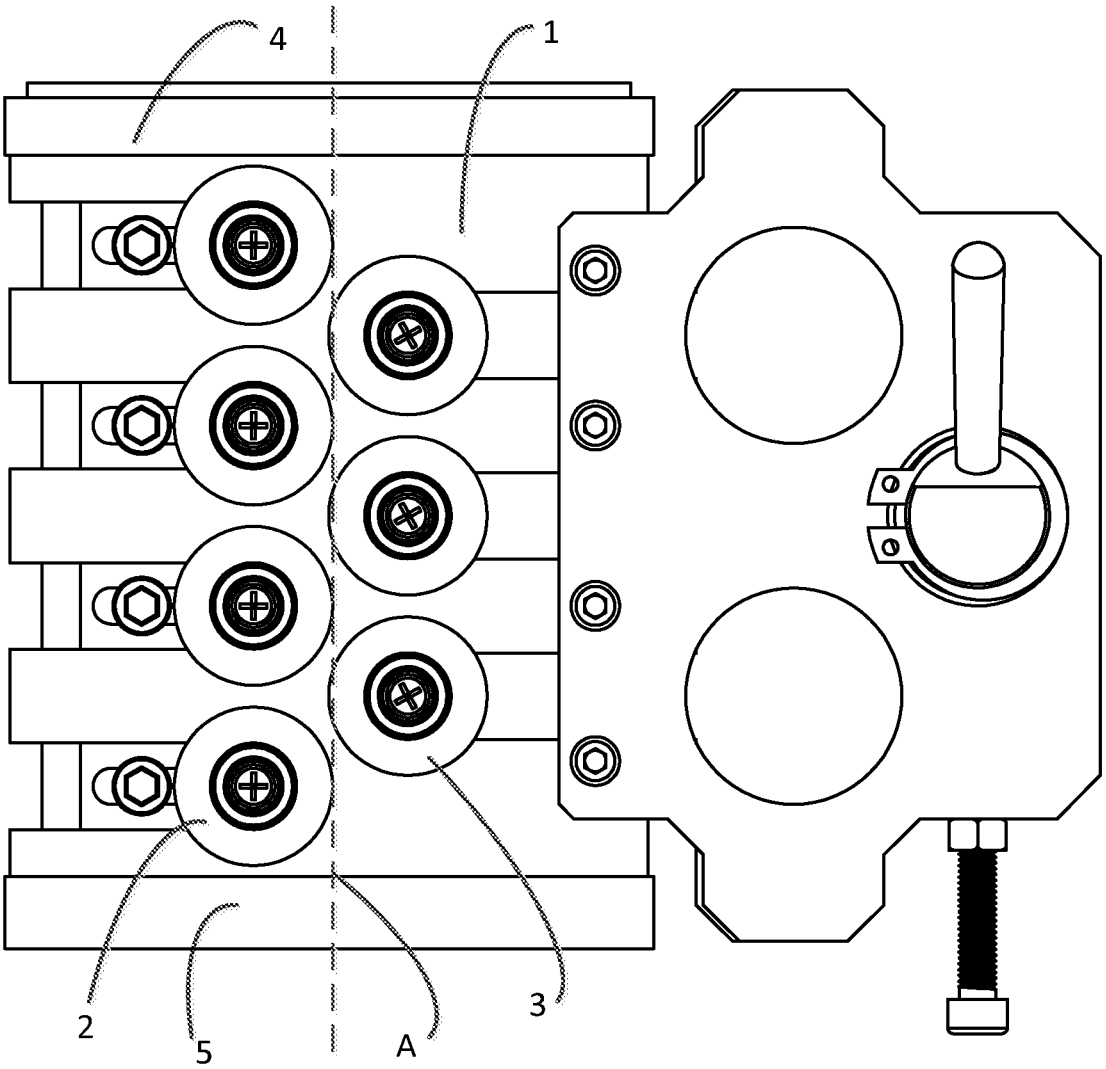
FIG. 6 is a top view of the cable straightening unit of FIG. 4.
Figure 7:
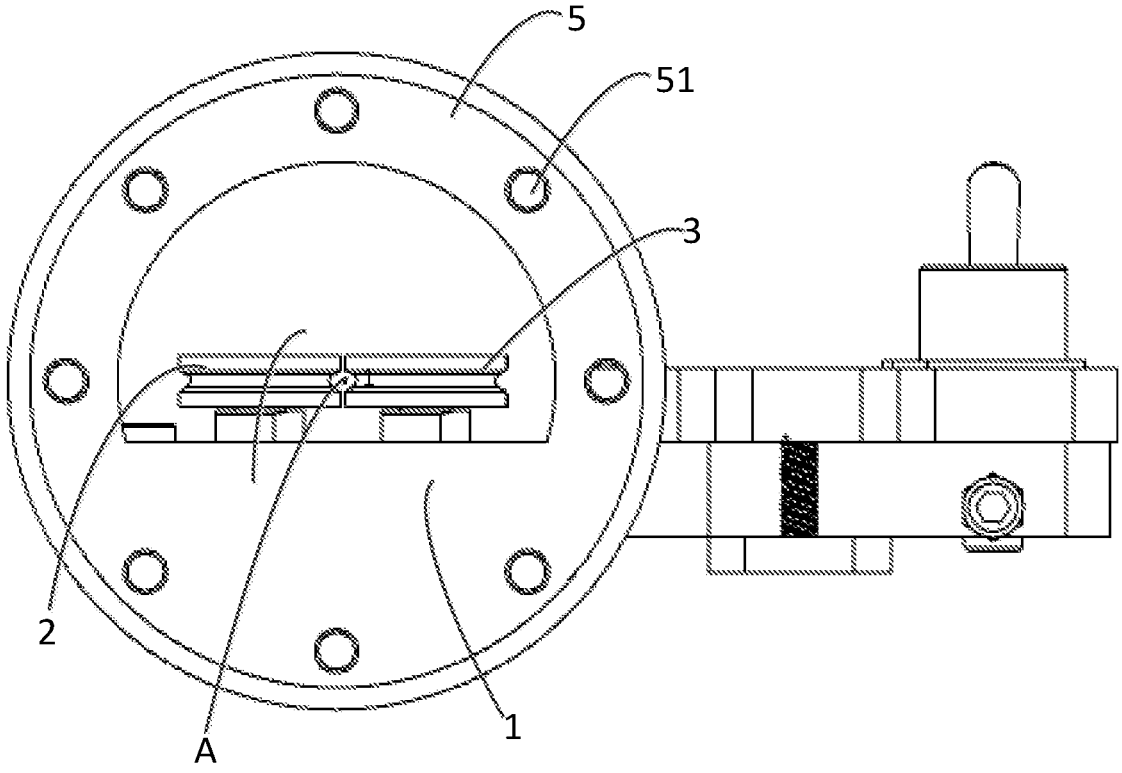
FIG. 7 is a side view of the cable straightening unit of FIG. 4.

In an exemplary embodiment of the disclosure, referring to FIGS. 4, 8 and 10, the first base 11 is provided with a plurality of second mounting grooves 112 extending perpendicular to the row direction, and the supporting arms 142 are respectively mounted in the second mounting grooves 112. A support frame 12 for supporting the first row of rollers 2 and the support arm 142 for supporting the second row of rollers 3 are arranged in the first mounting groove 111 and the second mounting groove 112, respectively, which may reduce the thickness of the first base 11 so that the center line A of the pressing path defined by the first row of rollers 2 and the second row of rollers 3 is approximately maintained at a center position of the mounting frame 4, 5.

In an exemplary embodiment of the disclosure, the rollers in the first row 2 and the rollers in the second row 3 of the two rows of rollers 2, 3 are spaced apart from each other. That is, one roller in the first row of rollers 2 is located between two adjacent rollers in the second row of rollers 3, as shown in FIGS. 1 to 3.

In an exemplary embodiment of the disclosure shown in FIGS. 1 to 3, the cable straightening device 200 comprises three cable straightening units 100, 100', 100", and two adjacent cable straightening units 100 and 100', or 100' and 100" are configured to respectively press the cable in two radial directions formed with about 90 degree therebetween. That is, the radial direction in which all the rollers of one cable straightening unit 100 are arranged and the radial direction in which all the rollers of the other cable straightening unit 100' are substantially perpendicular to each other. In an alternative exemplary embodiment of the disclosure, the cable straightening device 200 comprises three cable straightening units 100, 100', 100", and the three cable straightening units 100, 100', 100" respectively press the cable in three radial directions formed with about 120 degrees therebetween.

It should be understood that, in the above embodiments, as shown in FIGS. 8 to 13, the cable straightening unit 100 comprises a first part 10 and a second part 20 detachably mounted together. The first part 10 is mainly based on the first base 11 and components mounted on the first base 11, such as the support frame 12, the first row of rollers 2 mounted on the support frame 12 and the like. The second part 20 is mainly based on the second base 13 and components mounted on the second base 13 such as the movable frame 14, the second row of rollers 3 mounted on the movable frame 14, the adjustment device 15, and the like. The first part 10 and the second part 20 may be pre-assembled, and then the second base 13 of the second part is mounted on the first base 11 of the first part to obtain the cable straightening unit 100.

According to another embodiment of the disclosure, there is provided a cable straightening unit 100 adapted to straighten a cable such as an electrical cable, a wire, and an optical cable. The cable straightening unit 100 comprises a first part 10, a second part 20 and adjustment device 15. The first part 10 comprises a first base 11, and a plurality of first rows of rollers 2 mounted on the first base 11. The first rows of rollers 2 and second rows of rollers 3 are constructed to cooperate with each other to define a pressing path extending in a row direction. The cable passes through the pressing path and is pressed by the first rows of rollers 2 and the second rows of rollers 3. The second part 20 comprises a second base 13 mounted on the first base 11, and a plurality of second rows of rollers 3 movably mounted on the second base 13. The adjustment device 15 is mounted on the second base 13 and is configured to push the second rows of rollers 3 to move in a transverse direction perpendicular to the row direction to adjust a distance between an outer edge of each of the second rows of rollers 3 and the center line A of the press path. In this way, it is possible to flexibly press the cable of different diameters and eliminate the bent portions of the cable.

In an exemplary embodiment of the disclosure, the cable straightening unit 100 further comprises one or two mounting frames 4, 5 provided on at least one of the opposite ends of the first base 11 in the row direction. Each of the mounting frames 4, 5 is provided with a plurality of mounting portions 41, 51 arranged such that the first base 11 is mounted in different postures to allow the cable to be pressed by the first rows of rollers 2 and the second rows of rollers 3 in different radial directions.

In the cable straightening device 200, the plurality of cable straightening units 100, 100', 100" may be connected in series, which may flexibly change a mounting posture of the cable straightening unit 100, 100', 100" to press the cable in different radial directions of the cable so as to better straighten the cable.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate the embodiments of the disclosure by way of example, and should not be construed as limitation to the disclosure.

Although a few embodiments of the general inventive concept of the disclosure have been shown and described, it would be appreciated by those skilled in the art that changes or modification may be made to these embodiments without departing from the principles and spirit of the general inventive concept, the scope of which is defined in the claims and their equivalents.

It should be noted that, the word "comprise" doesn't exclude other elements or steps, and the word "a" or "an" doesn't exclude more than one. In addition, any reference numerals in the claims should not be interpreted as a limitation to the scope of the disclosure.

What is claimed is:

1. A cable straightening device, comprising:

a plurality of cable straightening units connected in series, each of the cable straightening units including:

a base including a first base, a second base mounted on the first base, a plurality of support frames mounted on the first base, and a movable frame mounted on the second base, the movable frame includes a main body portion movably mounted on the second base and a plurality of support arms extending parallel from the main body portion, a plurality of second rollers in the second row of rollers are each rotatably mounted at an end of one of the support arms;

a pair of rows of rollers mounted on the base and cooperating with each other to define a pressing path extending in a row direction, a cable being pressed by the rows of rollers while passing through the pressing path, a first row of rollers in the rows of rollers are mounted on the support frames and a second row of rollers in the rows of rollers are mounted on the movable frame, the support frames are movable along the first base in a transverse direction transverse to the pressing path and the movable frame is movable along the second base in the transverse direction to move the first row of rollers and the second row of rollers toward and away from the pressing path on opposite sides of the pressing path, the base includes an adjustment device mounted in the second base and configured to push the movable frame to move in a transverse direction perpendicular to the row direction to adjust a distance between an outer edge of the second rollers in the second row of rollers and a center line of the pressing path, the adjustment device includes a drive shaft rotatably mounted in the second base and a drive wheel mounted at an end of the drive shaft and having an axis offset from that of the drive shaft, the drive shaft is rotatable to drive the movable frame to move in the transverse direction by the drive wheel; and a mounting frame disposed on at least one end of a pair of opposite ends of the base in the row direction, any two adjacent cable straightening units are assembled together at the mounting frame of each so that center lines of the pressing paths of two adjacent cable straightening units are aligned with each other.

2. The cable straightening device of claim 1, wherein the mounting frames of the two adjacent cable straightening units are arranged such that the respective rows of rollers of the two adjacent cable straightening units press the cable in different radial directions.

3. The cable straightening device of claim 1, wherein in each of the cable straightening units, the mounting frame has a plurality of mounting portions arranged so that the base is mountable in different postures to allow the cable to be pressed by the two rows of rollers in different radial directions of the cable.

4. The cable straightening device of claim 3, wherein the mounting frame is formed as an annular frame, a center of an inscribed circle of the annular frame is located on the center line of the pressing path.

5. The cable straightening device of claim 1, wherein each of the support frames has a substantially L-shaped profile and includes a horizontal arm mounted on the first base by a first connection member and a vertical arm perpendicular to the horizontal arm and configured to rotatably support a first roller in the first row of rollers.

6. The cable straightening device of claim 5, wherein the first base has a plurality of first mounting grooves extending perpendicular to the row direction, the horizontal arm has an adjustment hole through which the first connection member passes to mount the horizontal arm in the first mounting groove so that a distance between an outer edge of the first roller and the center line of the pressing path is adjustable.

7. The cable straightening device of claim 1, wherein the adjustment device includes an operating portion protruding from the second base at an end of the drive shaft opposite to the drive wheel and operably driving the drive shaft to rotate.

8. The cable straightening device of claim 1, wherein the adjustment device includes a positioning portion adapted to prevent the drive shaft or the drive wheel from being rotated.

9. The cable straightening device of claim 8, wherein the positioning portion includes a screw rod protruding into a drive groove formed in the main body portion from outside and operably abutted against an outer edge of the drive wheel to prevent the drive wheel from being rotated.

10. The cable straightening device of claim 1, wherein the second base has a plurality of partition portions, each of the support arms passing through a gap between two adjacent partition portions.

11. The cable straightening device of claim 10, wherein the base includes a holding portion arranged on the partition portions and connected to the second base to hold the movable frame on the second base.

12. The cable straightening device of claim 1, wherein the base includes a plurality of elastic members each mounted on the second base at a first end and abutted against a side of the first base at a second end opposite the first end so that the movable frame is moved toward the pressing path against an elastic force of the elastic member.

13. The cable straightening device of claim 1, wherein the first base is formed with a plurality of mounting grooves extending substantially perpendicular to the row direction, the support arms are each mounted in one of the mounting grooves.

14. The cable straightening device of claim 1, wherein the rollers in the first row of rollers are arranged to be spaced apart from the rollers in the second row of rollers in each of the cable straightening units.

15. The cable straightening device of claim 1, wherein the plurality of cable straightening units is three cable straightening unit, a pair of adjacent cable straightening units presses the cable in a pair of radial directions perpendicular to each other.

* * * * *